US010203077B1

(12) United States Patent
Bremser et al.

(10) Patent No.: US 10,203,077 B1
(45) Date of Patent: Feb. 12, 2019

(54) PREFABRICATED COVE

(71) Applicant: Tempo Industries, LLC, Irvine, CA (US)

(72) Inventors: Michael D. Bremser, Seal Beach, CA (US); Thomas Lueken, Beaumont, CA (US); Shaun Toms, Fontana, CA (US); Dennis Pearson, Foothill Ranch, CA (US)

(73) Assignee: Tempo Industries, LLC, Irvine, CA (US)

( * ) Notice: Subject to any disclaimer, the term of this patent is extended or adjusted under 35 U.S.C. 154(b) by 0 days.

(21) Appl. No.: 15/712,905

(22) Filed: Sep. 22, 2017

(51) Int. Cl.

| | |
|---|---|
| ***F21V 11/00*** | (2015.01) |
| ***F21S 8/00*** | (2006.01) |
| ***F21V 21/02*** | (2006.01) |

(52) U.S. Cl.
CPC ..... *F21S 8/036* (2013.01); *F21S 8/037* (2013.01); *F21V 21/025* (2013.01)

(58) Field of Classification Search
None
See application file for complete search history.

(56) References Cited

U.S. PATENT DOCUMENTS

| | | | |
|---|---|---|---|
| 7,658,518 | B2 | 2/2010 | Shwisha |
| 7,726,840 | B2 | 6/2010 | Pearson et al. |
| 8,801,237 | B2 | 8/2014 | Pearson et al. |
| 8,864,347 | B2 | 10/2014 | Pearson et al. |
| 9,062,840 | B2 | 6/2015 | Swisha et al. |
| 2007/0171631 | A1 | 7/2007 | Davis |
| 2009/0135597 | A1 | 5/2009 | Kay |

FOREIGN PATENT DOCUMENTS

EP 2 927 563 A1 10/2015

OTHER PUBLICATIONS

Absent Installation Guide from Allights.com dated Nov. 16, 2015.
Product pagees from Allights.com downloaded Aug. 16, 2017.
AXIOM Direct Light Coves downloaded Aug. 16, 2017.

*Primary Examiner* — Vip Patel
(74) *Attorney, Agent, or Firm* — Lapple Ubell IP Law, LLP; Franklin D. Ubell

(57) ABSTRACT

First and second ribs are attached to a wall mounting bracket, each rib extending from the wall mounting bracket and then turning upwardly to form respective end tips. A front piece is shaped to pivotally mount to the wall mounting bracket and then rotate into a position where it snaps on to the end tips of the ribs to form a cove. Molded corner piece and sectional joiner components are also provided.

20 Claims, 16 Drawing Sheets

PREFABRICATED COVE

BACKGROUND OF THE DISCLOSURE

Field of the Disclosure

The subject disclosure relates to cove lighting and more particularly to a prefabricated, field installable cove wherein an LED lighting module may be mounted.

Description of Related Art

Cove lighting apparatus has been developed in the past, for example, as illustrated in U.S. patent application Ser. No. 15/346,650 entitled "Adaptive LED Cove Lighting System," which application is assigned to Tempo Industries, LLC, Irvine, Calif., and incorporated by reference herein.

SUMMARY

According to one aspect of the disclosure, an illustrative embodiment of a cove apparatus or cove structure may comprise a wall mounting bracket and first and second ribs attached to the wall mounting bracket, each rib extending from the wall mounting bracket and then turning upwardly to form respective end tips. A front piece is configured to attach to the ribs and wall mounting bracket to form a cove.

In one embodiment, the front piece has a bottom surface and a front surface which, in some embodiments, may meet at a selected angle. In an illustrative embodiment, the bottom surface of the front piece has a first channel or hook formed at a rear end thereof, and the front surface of the front piece has a second channel formed at a top end thereof. In such an embodiment, the wall mounting bracket may have a channel formed on a lower end thereof configured to engage the first channel or hook formed at the rear end of the front piece, and the second channel formed at the top end of the front surface may be positioned to engage the respective end tips of the first and second ribs.

According to another aspect of the disclosure, in one embodiment, the wall mounting bracket may have an interior or front surface on which are formed a horizontally running bottom hook and a horizontally extending projection, which are spaced apart from one another and configured to mount an LED light fixture module.

According to another aspect of the disclosure, in one embodiment, the cove apparatus may be so configured that the first channel or hook at the rear end of the front piece may first be engaged with the channel formed at the lower end of the wall mounting bracket and may thereafter be pivoted to a point where the respective end tips of the ribs may be snapped into the second channel formed at the top end of the front piece to form a cove.

According to another aspect of the disclosure, a cove for mounting LEDs may comprise a wall mounting bracket configured to mount an LED light fixture module on a front surface thereof; first and second ribs attached to the wall mounting bracket, each rib extending horizontally and then turning upwardly to form respective first and second end tips; and a front piece having a bottom surface and a front surface. According to another aspect of the disclosure, in one embodiment, the wall mounting bracket and front piece are so shaped and dimensioned that a rear end of the front piece may first be pivotally engaged with the lower end of the wall mounting bracket such that the front piece may thereafter be pivoted to a point where the respective first and second end tips of the first and second ribs may be snapped into a channel formed at the top end of the front piece to form a cove.

Illustrative embodiments may further include a corner piece having first and second corner wall bracket sections which are constructed and shaped in cross-section in the same manner as the wall mounting bracket and first and second corner front piece sections which are constructed and shaped in cross-section in the same manner as the front piece so as to pivotally mate with the respective corner wall bracket sections.

Illustrative embodiments may further include a molded sectional joiner component for joining a front piece to an adjacent corner front piece section, the joiner component having vertical and horizontal segments shaped to respectively insert into the front piece and the front corner piece section and to snugly mate with a floor and wall of each of the front piece and front corner piece sections.

According to one embodiment, the molded sectional joiner component has a rib projecting from a front of the vertical segment thereof and shaped so as to fit between the joined front piece components while at the same time creating a recessed space between respective front surfaces of the front piece and the corner piece front section shaped to be fillable with a filler material to accommodate for imperfections in the junction between the two components.

The disclosure further contemplates a method of constructing a cove comprising forming a wall mounting bracket configured to mount an LED light fixture module on a front surface thereof and forming first and second ribs to be attachable to the wall panel and to extend out from the wall panel and then turn upwardly to form respective first and second end tips. A front piece is then formed having a bottom surface and a front surface. Further according to the method, the wall mounting bracket and front piece are shaped and dimensioned such that a rear end of the front piece may first be pivotally engaged with a lower end of the wall piece and such that the front piece may thereafter be pivoted to a point where the respective first and second end tips of the first and second ribs may be snapped into the channel formed at the top end of the front piece.

DETAILED DESCRIPTION

Figure 1:
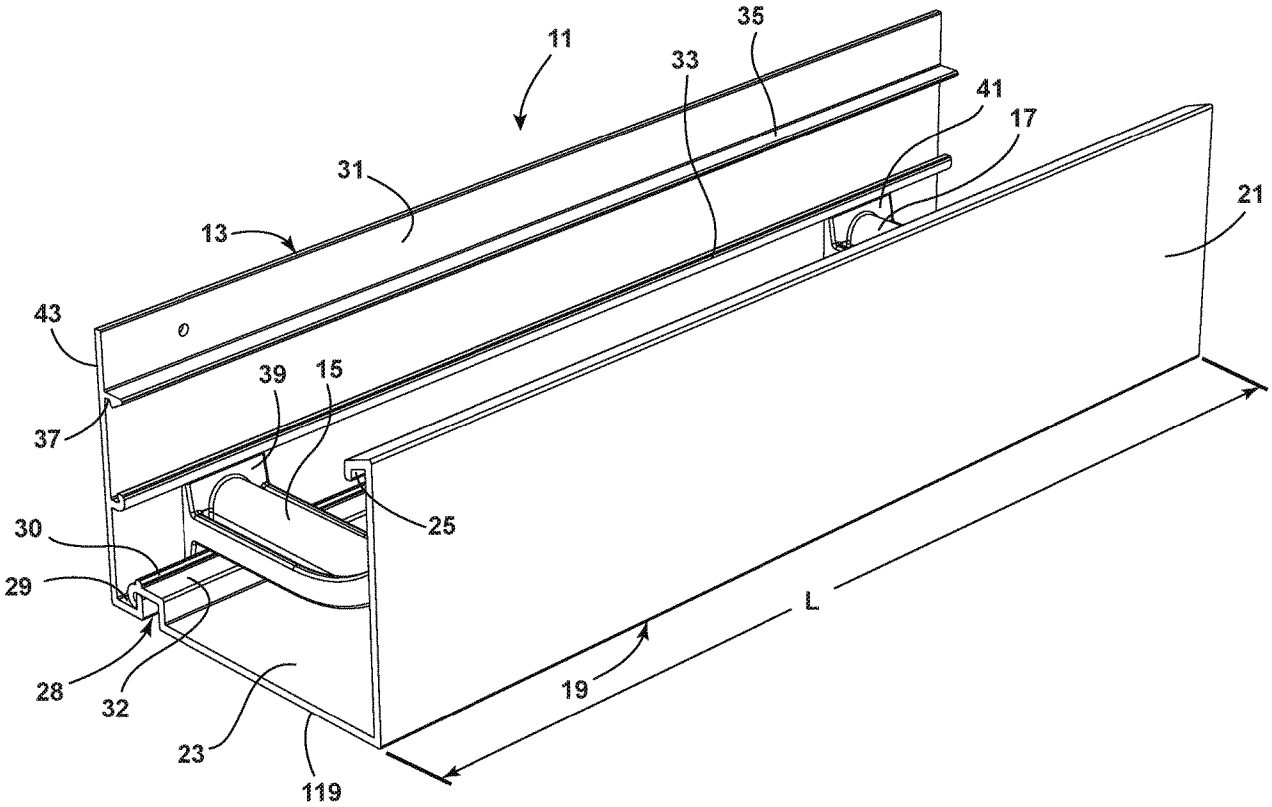
FIG. 1 is a perspective view of a prefabricated cove according to an illustrative embodiment.
Figure 2:
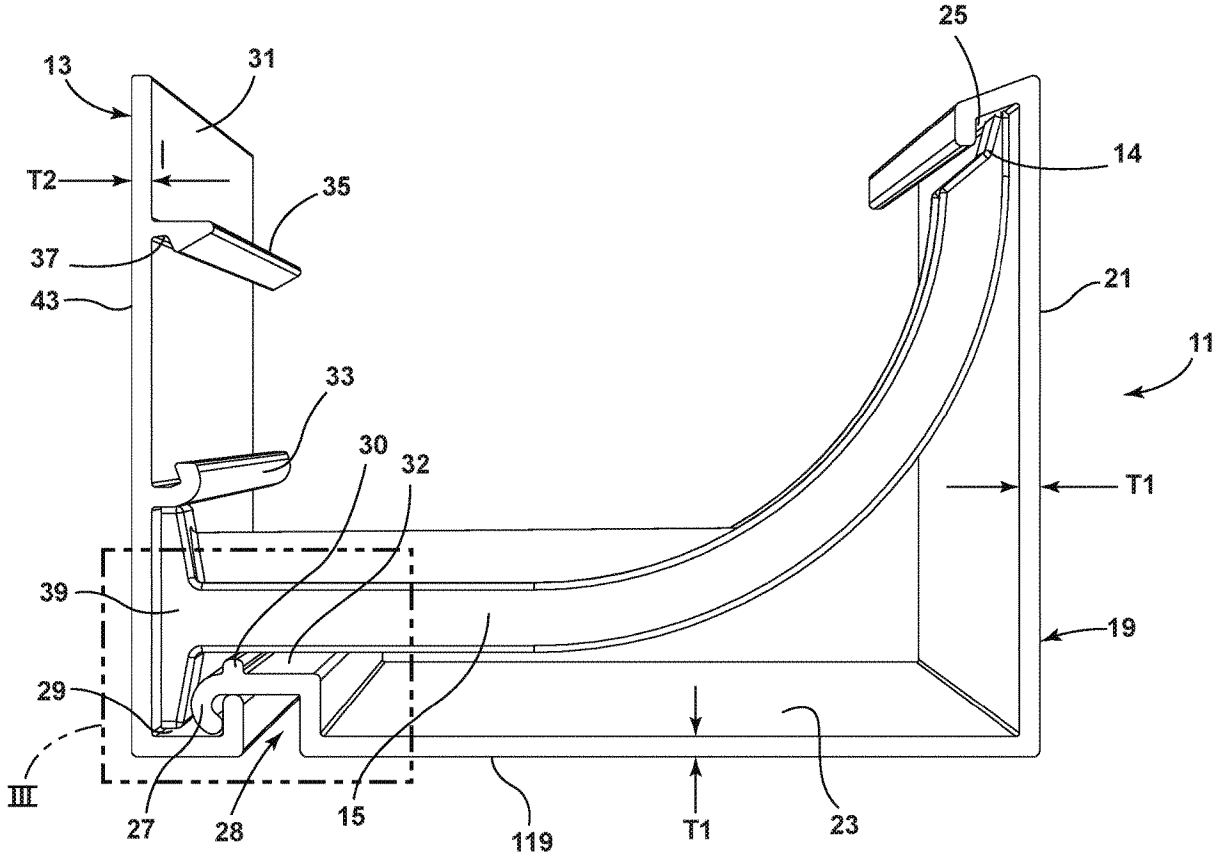
FIG. 2 is an end view of the illustrative embodiment of FIG. 1.
Figure 3:
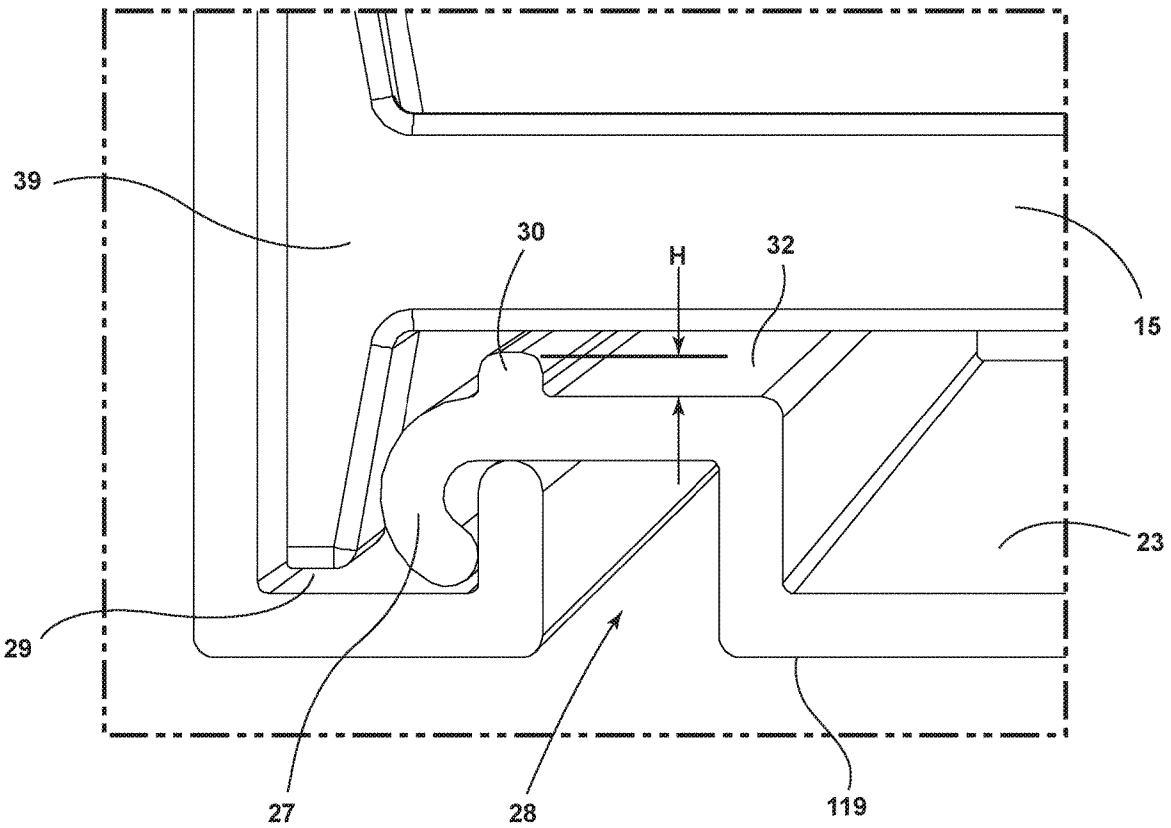
FIG. 3 is an enlarged fragmentary view of a portion of FIG. 2.
Figure 11:
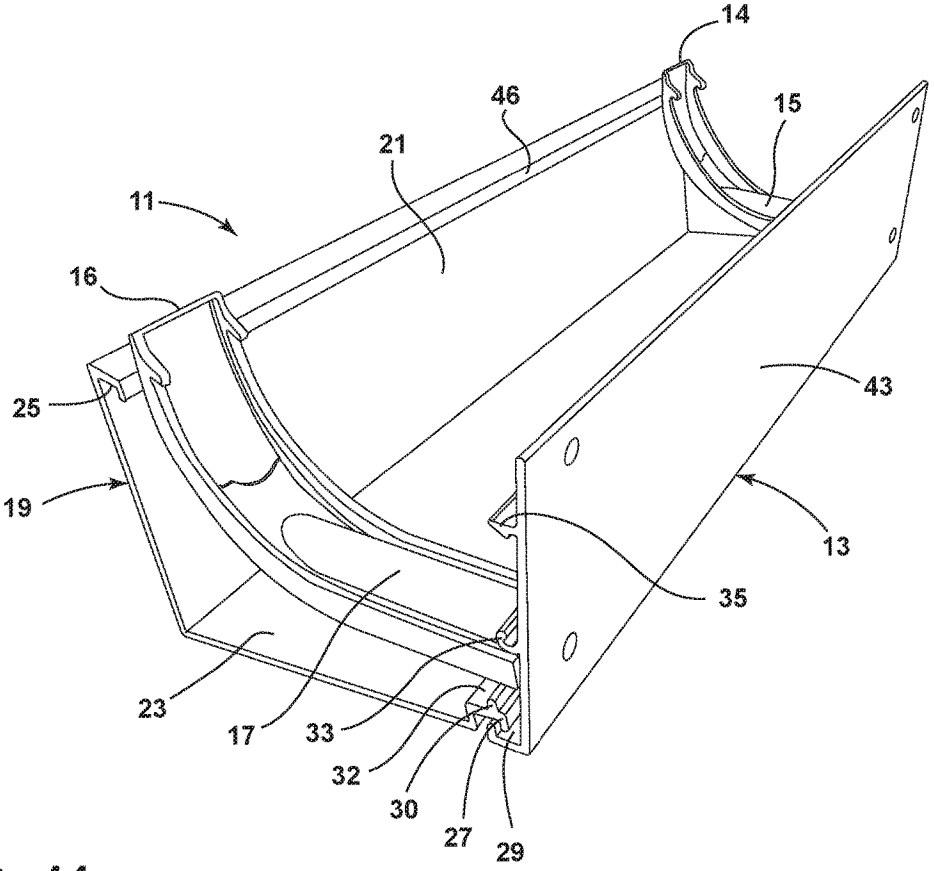
FIG. 11 is a perspective view of the apparatus at the sixth point installation.

An illustrative prefabricated, field installable cove 11 is shown in FIGS. 1-3. The cove 11 includes a wall mounting bracket 13, first and second ribs 15, 17, and a front piece 19. The ribs 15, 17 attach to the wall mounting bracket 13, project outwardly therefrom, and then curve upwardly to form respective end tips 14, 16, which are further illustrated in FIG. 11. In one embodiment, the ribs 15, 17 may be formed of PVC plastic and are relatively rigid parts.

The front piece 19 includes a rectangular front wall 21 and a rectangular floor 23. In the illustrative embodiment, the wall 21 and floor 23 meet at a right angle, but they may meet at other angles or be joined by a curved surface in other embodiments. A channel 25 is formed on an upper end of the front wall 21, which receives the respective end tips 14, 16 of the ribs 15, 17. A vertical downwardly projecting lip 27 is formed at a rear end of the floor 23 and fits into a channel 29 formed at the lower end of the wall mounting bracket 13. The lip 27 forms one side of a channel 28, which has a vertically projecting lip 30 formed on a top surface 32 thereof. In other embodiments, the lip 27 may be straight as opposed to hook-like such that the channel 28 has a rectangular cross-section. In one embodiment, the front piece 19 may be an extruded plastic part fabricated of PVC plastic of a thickness "T1" of, for example, 0.090 inches.

The wall mounting bracket 13 has a front surface 31 on which are formed a horizontally running bottom hook 33 and a projection 35, which defines a horizontally running groove 37. In illustrative embodiments, the hook 33 and projection 35 are configured to receive a light fixture module as described in more detail below. The wall mounting bracket 13 may be formed of PVC plastic of a thickness T2 of, for example, 0.090 inches. The thicknesses T1 and T2 and methods and materials used to fabricate various components may of course vary in other embodiments.

Figure 12:
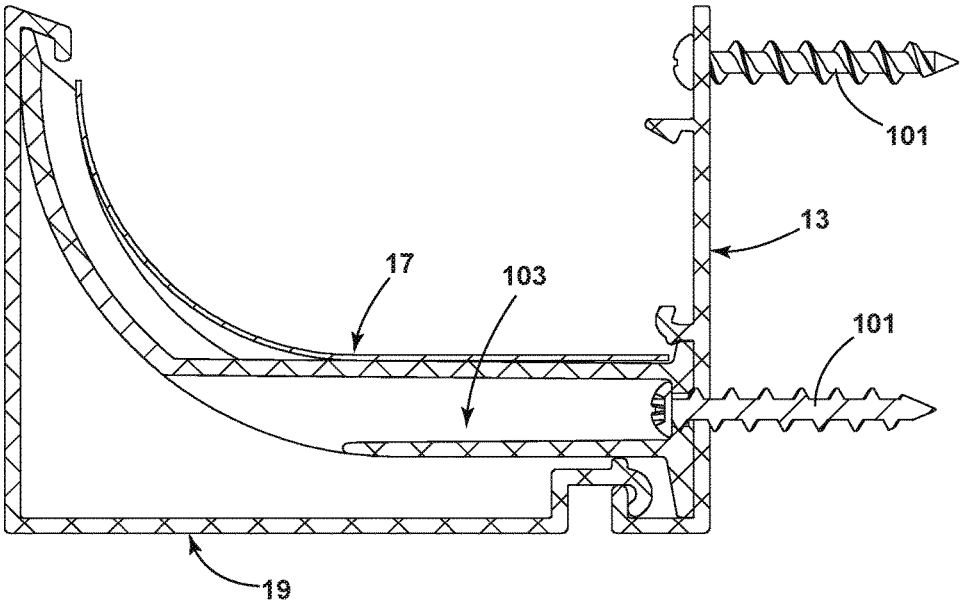
FIG. 12 is a side sectional view of an illustrative embodiment.

In the illustrative embodiment, each projecting rib 15, 17 has a rectangular base 39, 41, which fits into and may slide with respect to the channel 29 of the wall mounting bracket 13. In one embodiment, the ribs 15, 17 may be fixed in position in the channel 29 by suitable fastening devices such as screws 101 inserted through a channel 103 in the rib 15, 17 and passing thru wall mounting track 13, as shown in FIG. 12.

Figure 5:
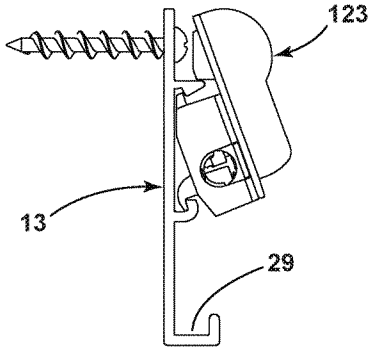
FIG. 5 is an end view of the apparatus at a second point during installation.
Figure 4:
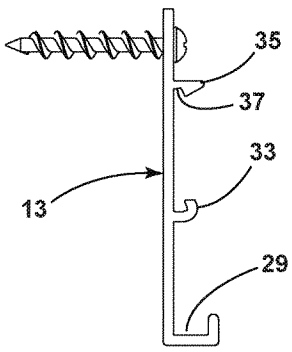
FIG. 4 is an end view of the apparatus of FIG. 1 at a first point during installation.
Figure 6:
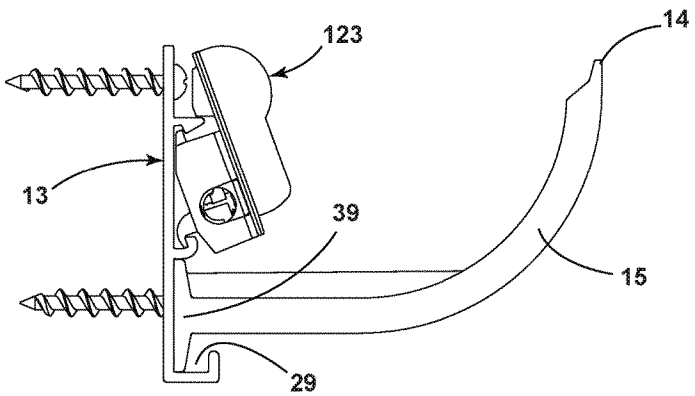
FIG. 6 is an end view of the apparatus at a third point during installation.
Figure 8:
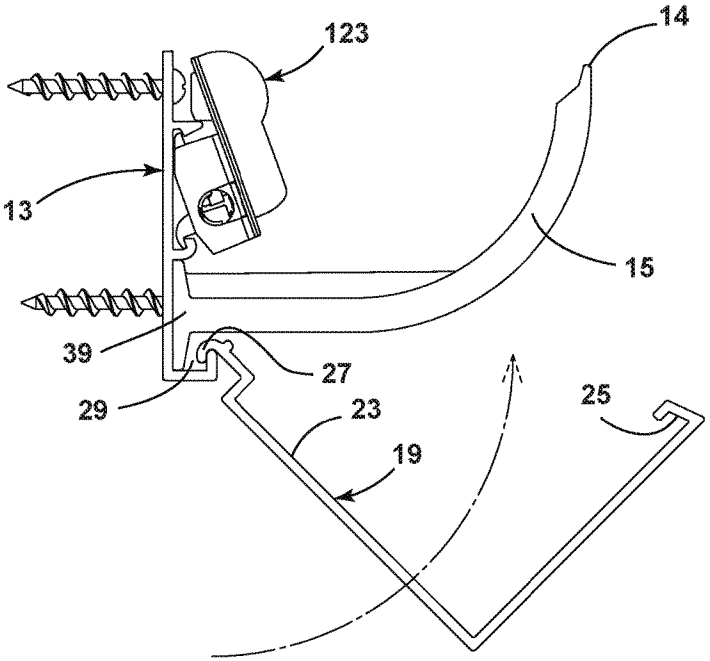
FIG. 8 is an end view of the apparatus at a fifth point during installation.
Figure 7:
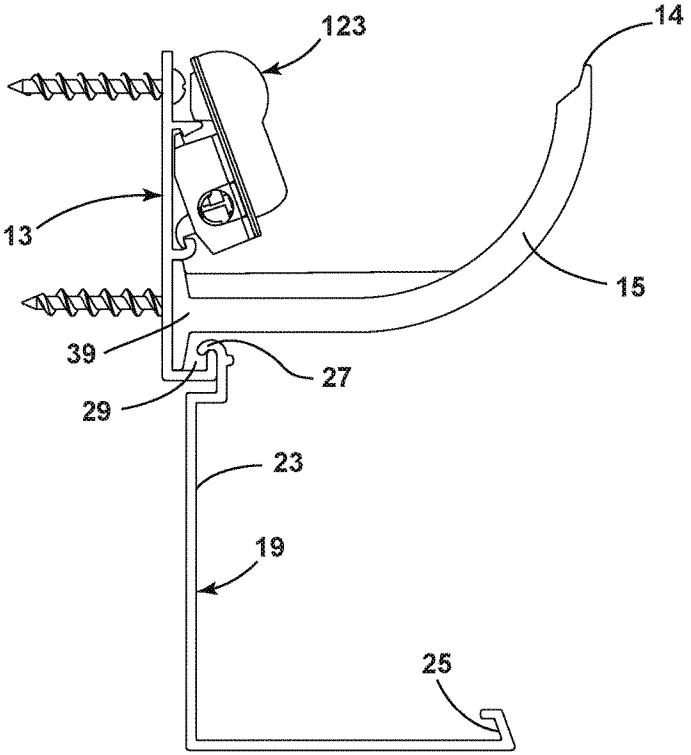
FIG. 7 is an end view of the apparatus at a fourth point during installation.
Figure 9:
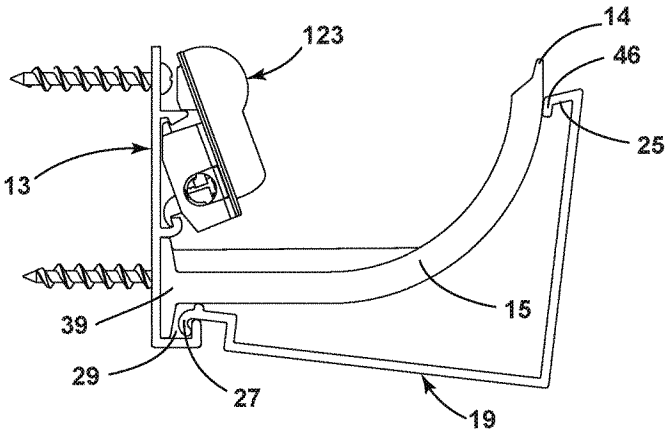
FIG. 9 is an end view of the apparatus at a sixth point during installation.
Figure 10:
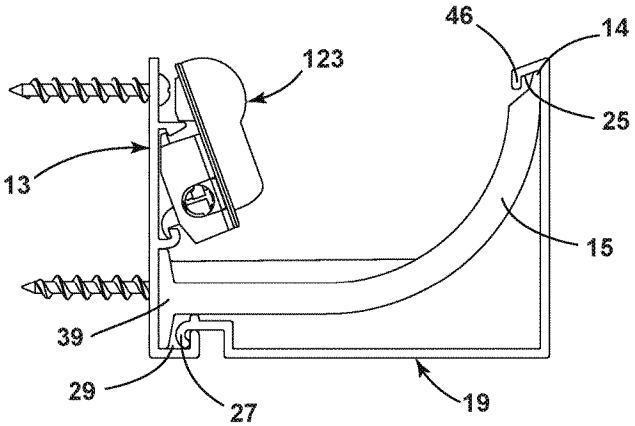
FIG. 10 is an end view of the apparatus after installation has been completed.

In one embodiment, the wall mounting bracket 13 with ribs 15, 17 attached may be attached to a wall or other surface and the front piece 19 may be engaged with the wall mounting bracket 13 and pivoted into engagement with the end tips 14, 16 of the ribs 15, 17 to thereby form the cove 11. One manner of installing the cove 11 is illustrated in more detail in connection with FIGS. 4-10. In a first step shown in FIG. 4, the wall mounting bracket 13 is attached to a wall using suitable fastening devices such as screws. In a second step shown in FIG. 5, an LED lighting module 123 is mounted to the wall mounting bracket 13, for example, as described below in connection with FIG. 13. In a third step shown in FIG. 6, the ribs 15, 17 are attached to the wall mounting bracket 13 by sliding their rectangular bases, e.g. 39, into the channel 29 and inserting screws or other fastening devices through the channels 103, in the ribs 15, 17 and through the wall mounting bracket 13. In a fourth step shown in FIG. 7, the front piece 19 is hooked on to and suspended from the wall mounting bracket 13 via pivotal engagement between the hook 27 and the channel 29. In this position, the floor 23 of the front piece 19 is in a vertical position. Next, as shown in FIGS. 8 and 9, the front piece 19 is pivoted to the position shown in FIG. 9 where the front surface 46 of the channel 25 abuts respective front surfaces of the ribs 15, 17. At this point, the ribs 15, 17 may be pushed or otherwise moved downwardly so as to snap into the channel 25 into the position shown in FIG. 10.

It will be observed that, in the illustrative embodiment, the vertically projecting lip 30 has a height "H" selected such that when the front piece 19 is in the locked position engaging ribs tips 14, 16, the hook 27 will remain in the channel 29 even when vertical upward force is applied to the bottom surface 119 of the front piece 19.

Figure 13:
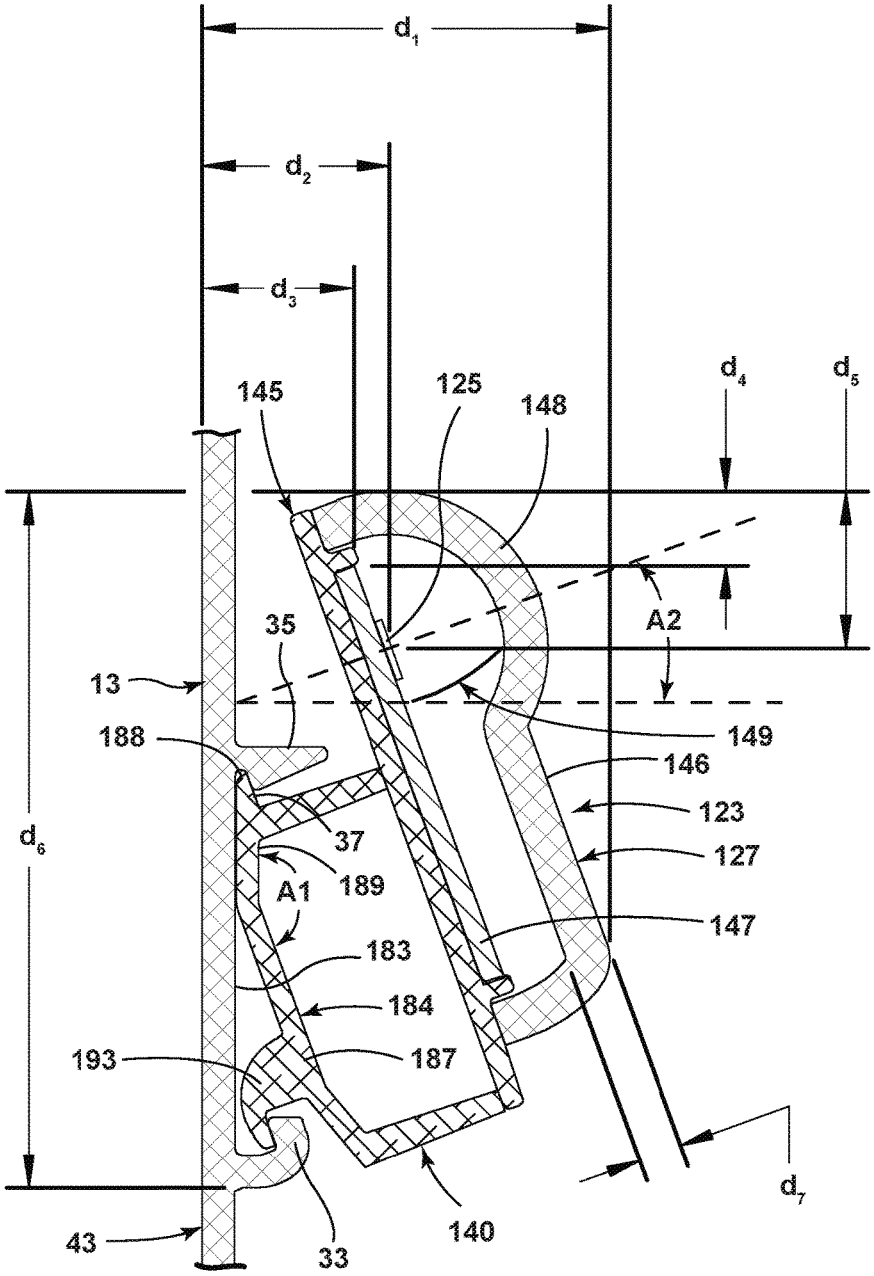
FIG. 13 is a side view illustrating an LED light fixture module attached to a wall mounting bracket of the embodiment of FIG. 1.

FIG. 13 illustrates an LED light fixture module 123 installed in the wall mounting bracket 13. A bottom surface 184 of the light fixture module 123 is shaped to have linear lower and upper segments 187, 189 which meet an obtuse angle "A1." A lip 188 is formed on the upper segment 189 and fits into the groove 37. In one embodiment, the groove 37 runs the entire length of the wall mounting bracket 13 and the lip 188 runs the entire length of the light fixture module 123. In one embodiment, first and second hooks, e.g. 193, are formed on the lower segment 187 and interlock or engage with the bottom hook 33 of the wall panel 13.

In one embodiment, the LEDs 125 are disposed at an angle A2 of 20 degrees to the vertical, and the obtuse angle A1 is 180−20=160 degrees. Various other LED disposition angles A2, for example, such as 10 degrees, may be selected in other embodiments. In one embodiment, the LEDs 125 are preferably placed as high as possible towards the top edge of the PCB 147. In various embodiments, the closest the LEDs 125 may be placed to the top edge of the PCB 147 is 30 thousandths of an inch due to various design considerations. Thus, according to illustrative embodiments, the proper LED angle is automatically achieved upon installation.

In some embodiments, it is also desirable to mount the LEDs 125 as close as possible to a vertical wall to which the wall panel 15 is attached and as high as possible without exposing the LEDs 125 to view when looking at a vertical wall to which the wall piece 122 is attached along a line of sight which is perpendicular to the vertical wall. In one illustrative embodiment, the dimensions in inches in FIG. 13 may be: d1=1.11, d2=0.51, d3=0.41, d4=0.20, d5=0.43, d6=1.91, and d7=0.12. These dimensions may of course vary in various applications and embodiments.

In the illustrative embodiment of FIG. 13, the cooperating parts are so shaped and dimensioned that the upper lip 188 may be inserted into the groove 37, which enables the hook 193 on the light fixture module 123 to snap into or otherwise come into engagement with the bottom hook 33 of the wall mounting track 13 so as to lock or retain the light fixture module 123 in a pre-determined fixed position with respect to the wall mounting bracket 13. In this position, the LEDs 125 are disposed at the selected angle, for example, 20 degrees to the horizontal, as discussed above. In this manner, a tool-less interconnection and installation of the light fixture module 123 with respect to the wall mounting bracket 13 is achieved.

It may be observed that the cove structure 11 just described is particularly suited to be installed directly onto previously installed wall materials including gypsum board, plywood or similar materials without concern for damaging the wall surface when attached using fasteners according to the illustrative embodiment. Furthermore, the design of illustrative embodiments is such that no gypsum board or other wall materials are required to be attached to the cove structure 11 in order to complete its fabrication. The cove 11 may be fabricated in various lengths "L," for example, from one foot to six feet or longer.

Figure 14:
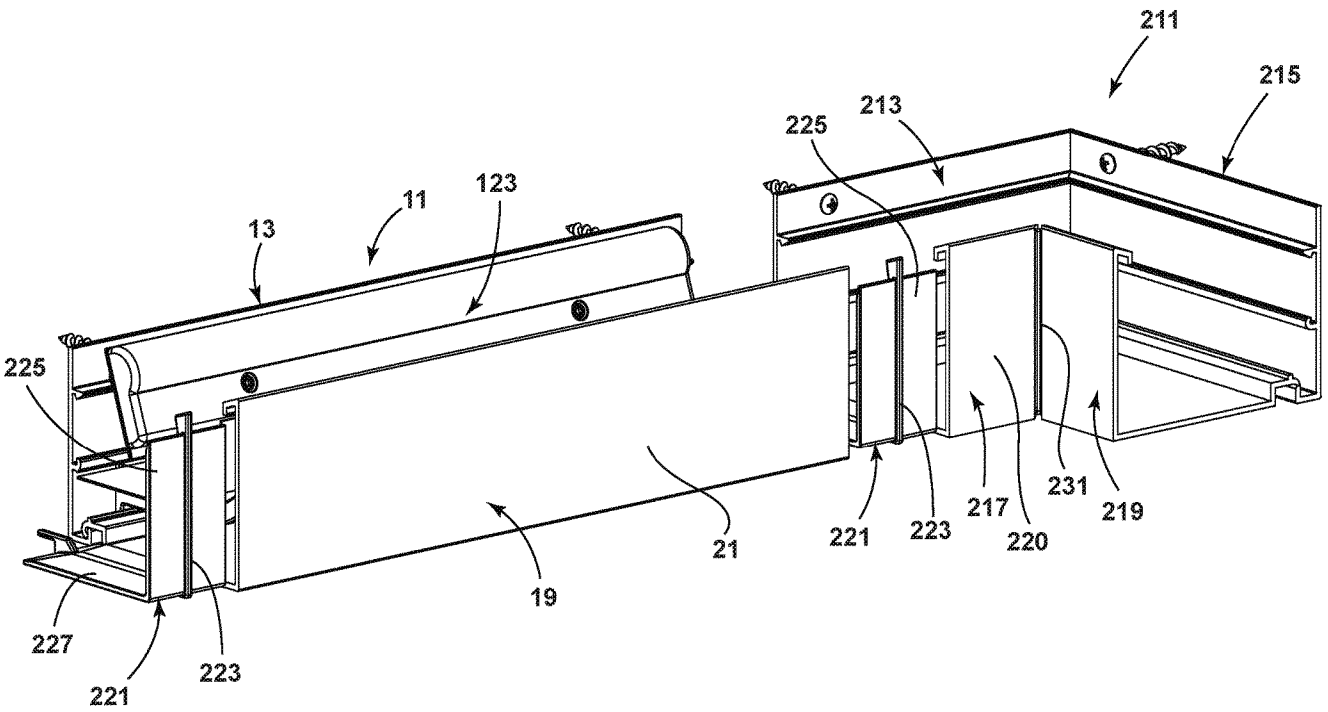
FIG. 14 is a perspective view showing an illustrative embodiment of a corner piece structure.

FIG. 14 illustrates a corner piece structure 211 employable in various embodiments. The corner piece 211 employs first and second corner wall bracket sections 213, 215, which are constructed and shaped in cross-section in the same manner as the wall mounting bracket 13. The corner piece structure 211 further employs first and second corner front piece sections 217, 219, which are constructed and shaped in cross-section in the same manner as the front piece 19 so as to pivotally mate with the wall bracket sections 213, 215.

Figure 15:
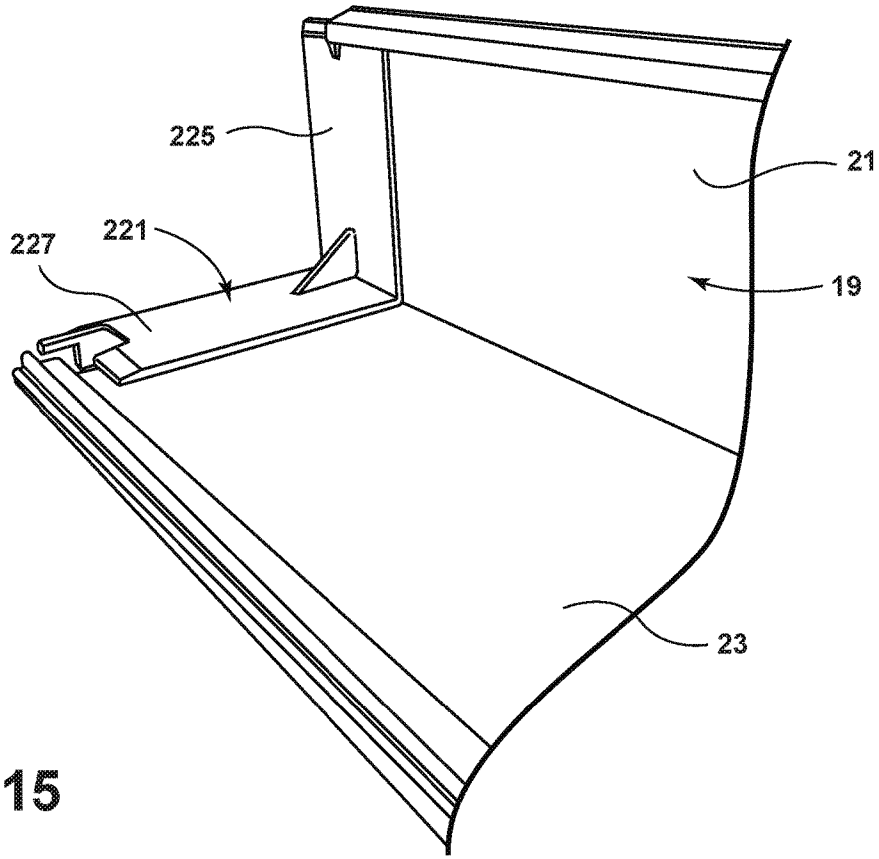
FIG. 15 is a perspective view illustrating a partially installed sectional joiner component according to an illustrative embodiment.
Figure 16:
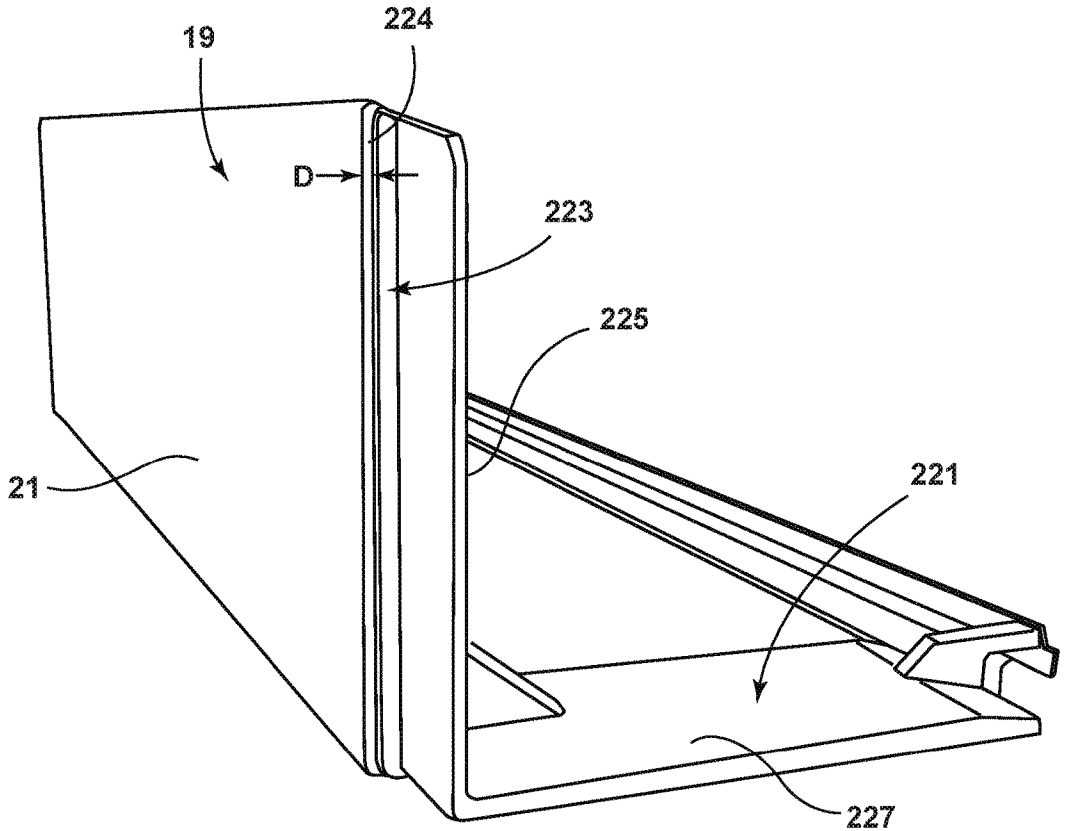
FIG. 16 is a second perspective view of the partially installed sectional joiner piece component.

In an illustrative embodiment, a molded sectional joiner component 221 (FIGS. 14-17) is used to join the front piece 19 of the cove 11 to the corner front piece section 217. For this purpose, the rectangular vertical and horizontal segments 225, 227 of the joiner component 221 are shaped to respectively insert into the front piece 19 and the front corner piece section 217 and to snugly mate with the floor and wall, e.g. 23, 21, of each of the front piece 19 and front corner piece section 217, as illustrated in FIGS. 15 and 16. In one embodiment, the joiner component mates tightly with the adjacent components so as to hold them together.

Figure 17:
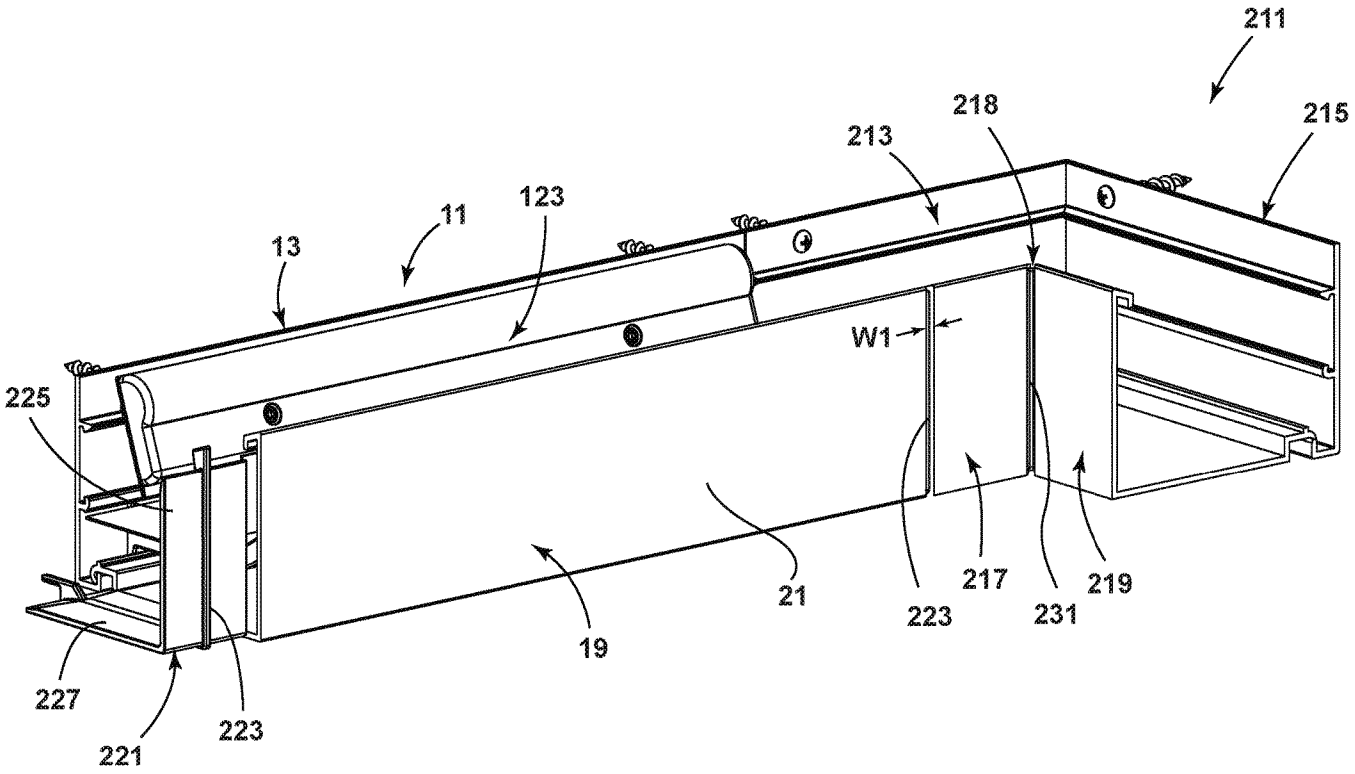
FIG. 17 is a perspective view illustrating the corner piece structure of FIG. 14 assembled together with the cove structure of FIG. 1.

A centrally positioned rib 223 projects from the front of the vertical segment 225 of the joiner component 221 and fits between the joined front piece components 19 and 217, as further illustrated in FIG. 17. As illustrated in FIG. 16, this rib 223 is recessed by a distance "D" from the respective front surfaces 21, 220 of the front piece 19 and the corner piece front section 217, in order to create a space which may be filled in with paintable caulk or other material in order to accommodate slight imperfections which may occur in the junction between the two components 19, 217. In one illustrative embodiment, the recessed space may have a width W1 of 0.10 inches (FIG. 17) and a depth D of 0.06 inches. Other dimensions may of course be used in other embodiments. As further illustrated in FIG. 14, a second molded sectional joiner component 221 located at the left end of the cove 11 may also be used to join the cove 11 to a second adjacent cove 11 (not shown) in a similar manner.

Figure 19:
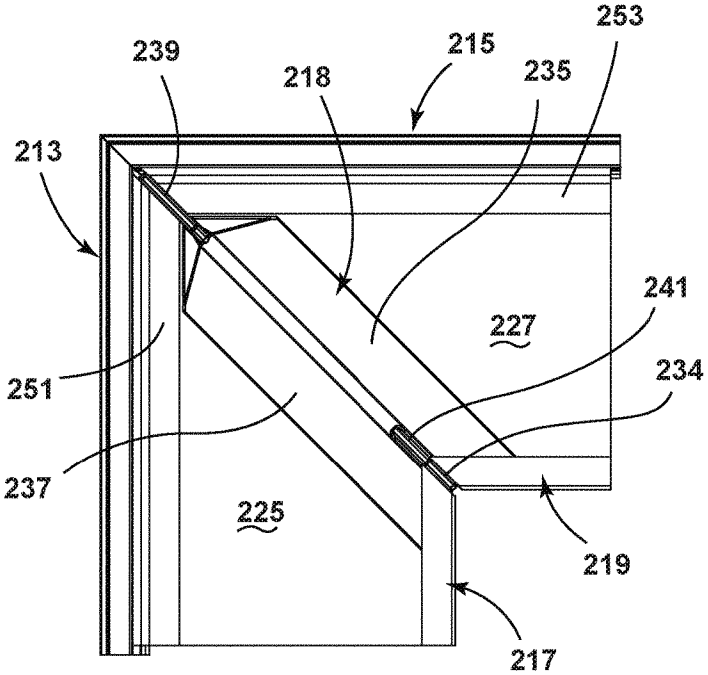
FIG. 19 is a top view of another illustrative corner piece structure.
Figure 18:
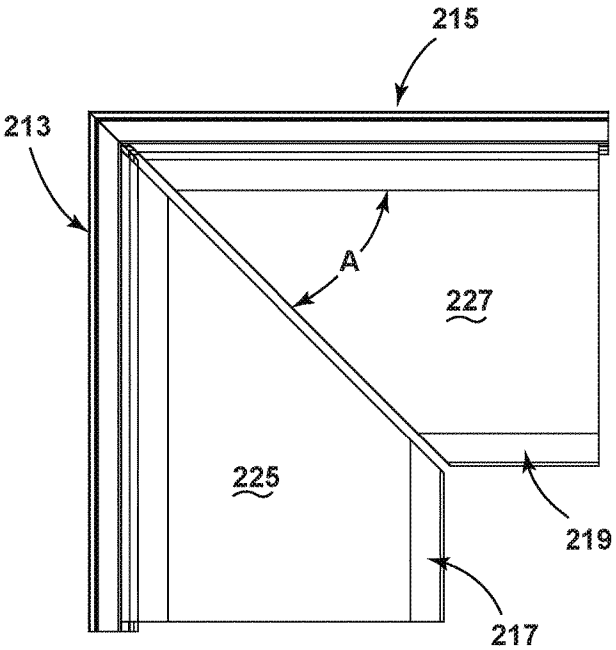
FIG. 18 is a top view of an illustrative corner piece structure.

As shown in the top view of FIG. 18, the respective floors 225, 227 of the front corner pieces 217, 219 meet at an angle A of 45 degrees in the illustrative embodiment. FIG. 19 illustrates the first front corner piece 217 joined to the second front corner piece 219 by a molded corner joiner component 218.

Figure 21:
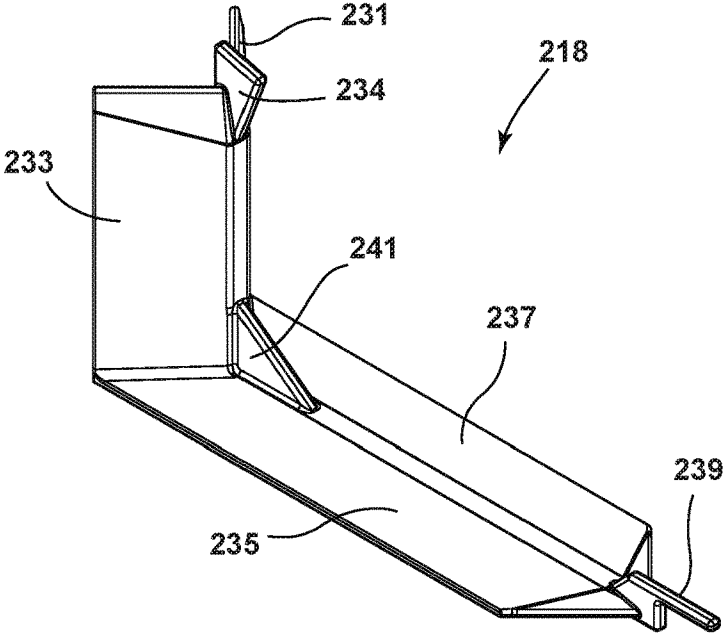
FIG. 21 is a second perspective view of the corner joiner component of FIG. 20.
Figure 20:
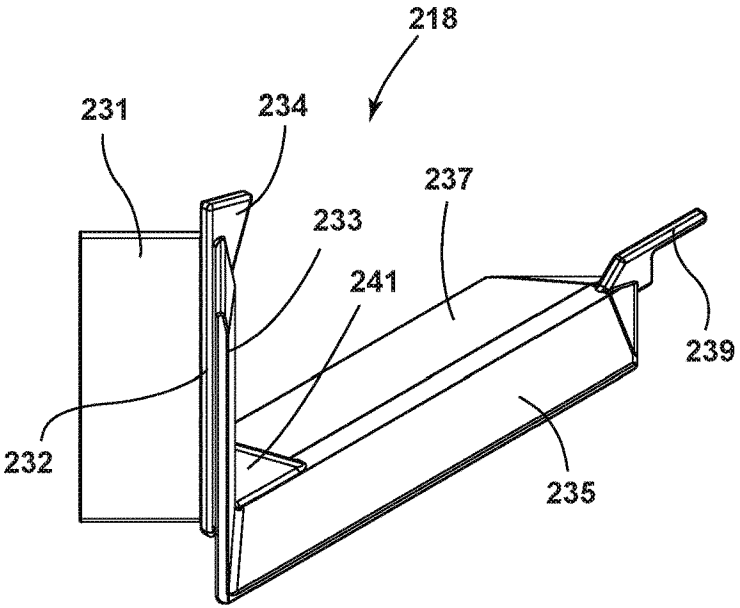
FIG. 20 is a perspective view illustrating a corner joiner component according to an illustrative embodiment.

The molded corner joiner component 218 of FIG. 19 may be constructed in a similar fashion to the joiner component 221 to snugly mate with and hold together the adjacent components 217, 219 and to provide a recess 230 of the same or similar dimensions for accommodating slight imperfections in the junction between these components 217, 219. As shown in FIGS. 20 and 21, the corner joiner component 218 comprises first and second generally rectangular vertical sections 231, 233 positioned at 90 degrees to one another and first and second horizontal floor sections 235, 237.

As further shown in FIGS. 20 and 21, the generally rectangular, perpendicularly disposed vertical sections 231, 233 of the corner joiner component 218 are attached to opposite sides of a centrally positioned rib 232, which fits between the joined front corner pieces 217, 219 so as to create the recess 230. The rib 232 terminates in an upper projection 234, whose top edge is angled at the same angle as the top edges 245, 247 of the respective corner pieces 217, 219 in one embodiment. The corner joiner component 218 further includes a triangular structural support 241 and a horizontal rear finger 239, which is shaped to rest at the junction of respective rear horizontal surfaces 251, 253 (FIG. 19) of the front corner pieces 217, 219.

Figure 22:
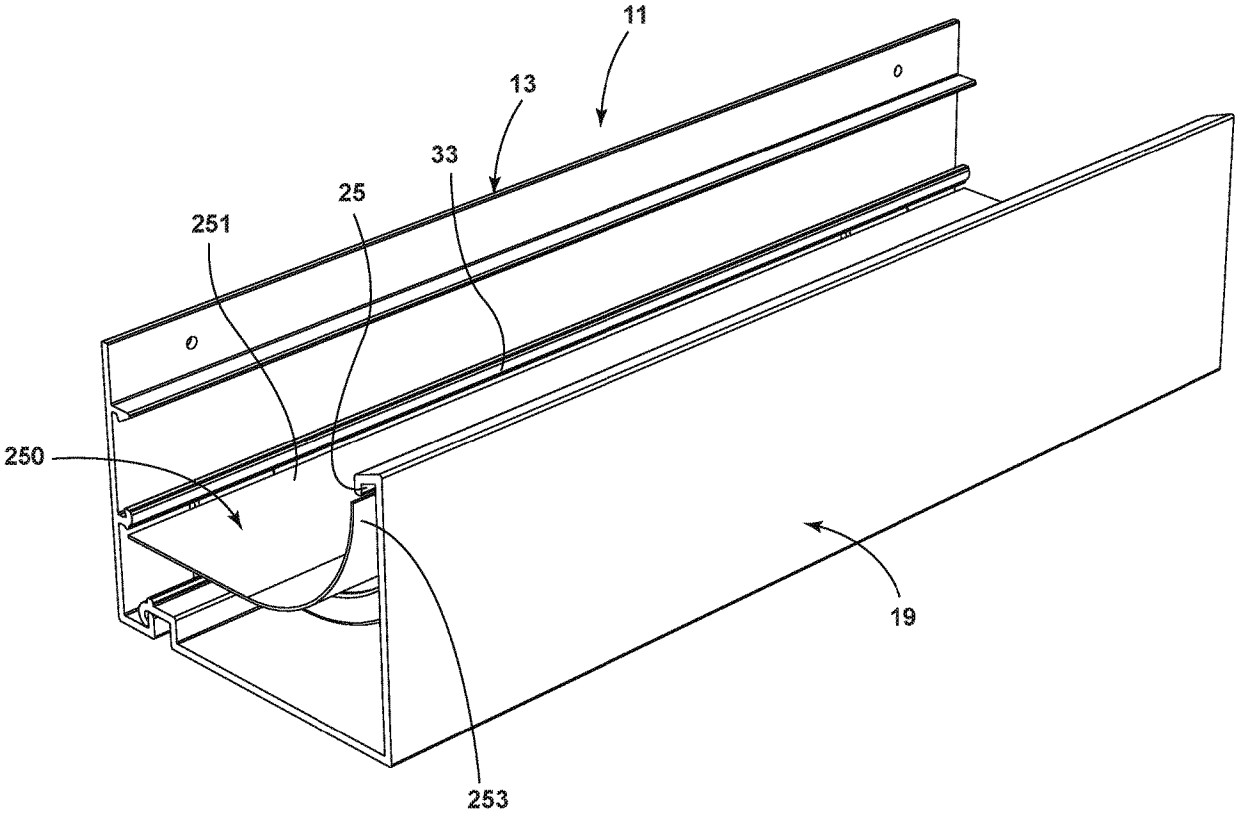
FIG. 22 is a perspective view of a cove embodiment employing a snap-in reflector component.

As shown in FIG. 22, in one embodiment, a curved reflector 250 may be configured to have sufficient flexibility and appropriate shape to snap into the cove 11 with one end 251 fitting beneath the bottom hook 33 of the wall mounting track 13 and the opposite end 253 fitting into the channel 25 of the front piece 19. The curved reflector 250 can be constructed of plastic or other highly reflective materials in order increase light output from the cove 11. For applications involving white light, use of a white reflector is preferred in order to prevent any reflected light from having altered spectral properties that could be visible to the human eye as a color variation observed on surrounding surfaces illuminated by the light module 123.

Thus, those skilled in the art will appreciate that various adaptations and modifications of the just described illustrative embodiments can be configured without departing from the scope and spirit of the invention. Therefore, it is to be understood that, within the scope of the appended claims, the invention may be practiced other than as specifically described herein.

What is claimed is:

1. A cove apparatus for mounting an LED light fixture comprising:

a wall mounting bracket having a horizontally running bottom hook and a horizontally running projection spaced apart from one another and configured to mount an LED light fixture module, the wall mounting bracket further having a channel formed at a lower end thereof;

first and second ribs attached to the wall, mounting bracket, each rib extending horizontally and then turning upwardly to form respective first and second end tips;

a front piece having a bottom surface and a front surface, the bottom surface having a first channel formed at a rear end thereof, the front surface having a second channel formed at a top end thereof;

wherein the wall mounting bracket and front piece are so shaped and dimensioned that the first channel at the rear end of the front piece is first pivotally engageable with the channel formed at the lower end of the wall mounting bracket and such that the front piece is thereafter pivotable to a position where the respective first and second end tips of the first and second ribs snap into the second channel formed at the top end of the front piece.

2. The cove apparatus of claim 1 wherein the bottom surface and front surface of the front piece meet at a selected angle.

3. The cove apparatus of claim 1 wherein the bottom surface and front surface of the front piece are joined by a surface having a curved contour.

4. The cove apparatus of claim 1 further comprising a molded sectional joiner component configured to join the front piece to an adjacent corner front piece section, the joiner component having vertical and horizontal segments shaped to respectively insert into the front piece and the corner front piece section and to snugly mate with a floor and an interior wall of each of the front piece and the corner front piece section.

5. The cove apparatus of claim 4 wherein the molded sectional joiner component has a rib projecting from a front of the vertical segment thereof and shaped so as to partially fill a gap between the joined front piece and corner front piece section while at the same time creating a recess between respective front surfaces of the front piece and the corner front piece section, the recess being shaped to be fillable with a filler material to accommodate for imperfections in a junction between the front piece and the corner front piece section.

6. The cove apparatus of claim 1 further comprising a corner piece having first and second corner wall bracket sections which are constructed and shaped in cross-section in the same manner as the wall mounting bracket, the corner piece further having first and second corner front piece sections which are constructed and shaped in cross-section in the same manner as the front piece so as to pivotally mate with the respective first and second corner wall bracket sections.

7. A cove apparatus for mounting an LED light fixture comprising:

a wall mounting bracket configured to mount an LED light fixture module on a front surface thereof;

first and second ribs attached to the wall mounting bracket, each rib extending horizontally and then turning upwardly to form respective first and second end tips;

a front piece having a bottom surface and a front surface, the front surface having a channel formed at a top end thereof;

wherein the wall mounting bracket and front piece are so shaped and dimensioned that a rear end of the front piece is first pivotally engageable with the lower end of the wall mounting bracket such that the front piece is thereafter be pivotable to a position where the respective first and second end tips of the first and second ribs snap into the channel formed at the top end of the front piece.

8. A cove apparatus for mounting an LED light fixture comprising:

a wall mounting bracket having a horizontally running bottom hook and a horizontally running projection spaced apart from one another and configured to mount an LED light fixture module, the wall mounting bracket further having a channel formed at a lower end thereof;

first and second ribs attached to the wall mounting bracket, each rib extending horizontally and then turning upwardly to form respective first and second end tips; and a front piece having a bottom surface and a front surface, the bottom surface having a first channel formed at a rear end thereof, the front surface having a second channel formed at a top end thereof;

the first channel at the rear end of the front piece being engaged with the channel formed at the lower end of the wall mounting bracket and the respective first and second end tips of the first and second ribs residing in the second channel formed at the top end of the front piece.

9. The cove apparatus of claim 8 wherein the bottom surface and front surface of the front piece meet at a selected angle.

10. The cove apparatus of claim 8 wherein the bottom surface and front surface of the front piece are joined by a surface having a curved contour.

11. The cove apparatus of claim 8 further comprising a molded sectional joiner component configured to join the front piece to an adjacent corner front piece section, the joiner component having vertical and horizontal segments shaped to respectively insert into the front piece and the corner front piece section and to snugly mate with a floor and an interior wall of each of the front piece and corner front piece section.

12. The cove apparatus of claim 11 wherein the molded sectional joiner component has a rib projecting from a front of the vertical segment thereof, the rib being shaped so as to partially fill a gap between the joined front piece and corner front piece section while at the same time creating a recess between respective front surfaces of the front piece and the corner front piece section, the recess being shaped to be fillable with a filler material to accommodate for imperfections in the junction between front piece and corner front piece section.

13. The cove apparatus of claim 8 further comprising a corner piece having first and second corner wall bracket sections which are constructed and shaped in cross-section in the same manner as the wall mounting bracket, the corner piece further having first and second corner front piece sections which are constructed and shaped in cross-section in the same manner as the front piece so as to mate with the respective first and second corner wall bracket sections.

14. A cove apparatus for mounting an LED light fixture comprising:

a wall mounting bracket configured to mount an LED light fixture module on a front surface thereof;

first and second ribs attached to the wall mounting bracket, each rib extending horizontally and then turning upwardly to form respective first and second end tips;

a front piece having a bottom surface and a front surface, the front surface having a channel formed at a top end thereof; and wherein a rear end of the front piece engages the lower end of the wall mounting bracket and wherein the respective first and second end tips of the first and second ribs each reside in the channel formed at the top end of the front piece.

15. The cove apparatus of claim 14 wherein the engagement between the rear end of the front piece and the lower end of the wall mounting bracket is a pivotal engagement.

16. The cove apparatus of claim 8 wherein the engagement between first channel at the rear end of the front piece and the channel formed at the lower end of the wall mounting bracket is a pivotal engagement.

17. A cove apparatus comprising:

a wall mounting bracket;

first and second ribs attached to the wall mounting bracket, each rib extending from the wall mounting bracket and then turning upwardly to form respective first and second end tips; and wherein the front piece and wall mounting bracket are so structured and dimensioned that the front piece is pivotally mountable to the wall mounting bracket and is thereafter rotatable into a position where the front piece snaps on to the respective first and second end tips of the first and second ribs to form a cove.

18. A method of constructing a cove comprising:

forming a wall mounting bracket configured to mount an LED light fixture module on a front surface thereof;

forming first and second ribs to be attachable to the wall mounting bracket and so as to extend out from the wall mounting bracket and then turn upwardly to form respective first and second end tips;

forming a front piece having a bottom surface and a front surface and a channel formed at a top end thereof; and shaping and dimensioning the wall mounting bracket and front piece such that a rear end of the front piece can first be pivotally engaged with a lower end of the wall piece and such that the front piece can thereafter be pivoted to a position where the respective first and second end tips of the first and second ribs can be snapped into the channel formed at the top end of the front piece.

19. A molded sectional joiner component for joining a front piece of a cove structure to an adjacent corner front piece section comprising:

vertical and horizontal segments shaped to respectively insert into the front piece and the corner front piece section and to snugly mate with a floor and an interior wall of each of the front piece and the corner front piece section; and a rib projecting from a front of the vertical segment and shaped so as to partially fill a space between the joined front piece and the corner front piece section while at the same time creating a recess shaped to be fillable with a filler material to accommodate for imperfections in a junction between the front piece and the corner front piece section.

20. A molded sectional joiner component for joining a front piece of a cove structure to an adjacent front piece of an adjacent cove structure comprising:

vertical and horizontal segments shaped to respectively insert into the front piece and the adjacent front piece of the adjacent cove and to snugly mate with a floor and an interior wall of each of the front piece and the adjacent front piece; and a rib projecting from a front of the vertical segment and shaped so as to partially fill a space between the front piece and the adjacent front piece, while at the same time creating a recess shaped to be fillable with a filler material to accommodate for imperfections in a junction between the front piece and the adjacent front piece.

* * * * *